US005441026A

United States Patent [19]

Akimoto

[11] Patent Number: 5,441,026

[45] Date of Patent: Aug. 15, 1995

[54] FUEL PRESSURE CONTROL SYSTEM FOR HIGH PRESSURE FUEL INJECTION ENGINE

[75] Inventor: Akira Akimoto, Musashino, Japan

[73] Assignee: Fuji Jukogyo Kabushiki Kaisha, Tokyo, Japan

[21] Appl. No.: 340,344

[22] Filed: Nov. 14, 1994

[30] Foreign Application Priority Data

Nov. 18, 1993 [JP] Japan ..... 5-289298

[51] Int. Cl.[6] ..... F02B 77/00

[52] U.S. Cl. ..... 123/198 D; 123/198 DB

[58] Field of Search ..... 180/277, 284; 280/735; 123/198 D, 198 DB

[56] References Cited

U.S. PATENT DOCUMENTS 4,319,550 3/1982 Ishii et al. ..... 123/198 DB
5,033,428 7/1991 Sasaki ..... 123/198 D
5,152,265 10/1992 Hummel et al. ..... 123/198 DB

FOREIGN PATENT DOCUMENTS 0322599 7/1989 European Pat. Off. .

*Primary Examiner*—Noah P. Kamen
*Attorney, Agent, or Firm*—Beveridge, DeGrandi, Weilacher & Young

[57] ABSTRACT

When a damage in a high pressure line of a fuel pressure control system for a high pressure fuel injection engine is detected the fuel pressure is reduced to prevent fuel from blowing out of the damaged part. An acceleration detected by the acceleration sensor is compared with a set value. When the detected acceleration exceeds the set value, the system determines that such an emergency as a collision has happened, fully opens a solenoid type high pressure regulator provided downstream of the high pressure line of fuel system and stops the operation of a feed pump provided in a low pressure delivery line. Thereupon, the feed pump stops delivering the fuel to a high pressure fuel pump. On the other hand, the high pressure regulator is in a fully opened position. Thus, the fuel pressure in the high pressure line is relieved to a fuel tank. Therefore, even if a strong impact due to a collision gives damages to the high pressure line, the system can prevent the fuel from blowing out of the damaged part since the fuel pressure in the high pressure line has been already reduced.

6 Claims, 14 Drawing Sheets

NORMAL

COLLISION

FUEL PRESSURE CONTROL SYSTEM FOR HIGH PRESSURE FUEL INJECTION ENGINE

BACKGROUND OF THE INVENTION

1. Field of the Invention

The present invention relates to a fuel pressure control system for a high pressure fuel injection engine which immediately reduces the fuel pressure in the high pressure line of the fuel system to suppress a blowout of fuel from a damaged part in the high pressure line when a car body receives a strong impact.

2. Related Art of the Invention

Generally, most of such high pressure fuel injection engines, when operating, continuously regulates a predetermined line pressure by a high pressure regulator and control an amount of injected fuel by fuel injection timing.

When a car body receives a sudden impact in, for example, a collision and the high pressure line is damaged from the impact, fuel in the high pressure line may blow out from the damaged part.

As conventional means for reducing the fuel pressure, Japanese laid open utility model application No. 57-25157, for example, discloses a system momentarily stopping or reducing fuel delivery to an injector when the fuel pressure in the high pressure line is abnormally high and a relieving system for the fuel pressure out of the high pressure line to reduce the fuel pressure when an engine stop is detected.

It is contemplated as a technique of preventing the blowout of fuel from the high pressure line of a fuel system where damage is detected, wherein the line pressure and fuel system immediately relieves the fuel pressure when the line pressure is rapidly reduced.

However, the fuel pressure in the high pressure line is so high that a considerable amount of the fuel has already been blown out of the damaged part in the fuel system when the fuel pressure reduction is detected. Thus, the fuel blowout cannot be prevented even if the fuel pressure is reduced after the detection of the line damage.

In addition, since the fuel system must accurately detect a small change in the line pressure in order to early detect damage in the high pressure line, the fuel system tends to provide a maldetection, which provides trouble for the normal running of a car.

SUMMARY OF THE INVENTION

The present invention was made in view of the above-described situation.

An object of the present invention is to provide a fuel pressure control system for a high pressure fuel injection engine which is able to previously detect the possibility of a damage occurrence in a high pressure line of the fuel system and prevent a fuel blowout from a damaged part in the high pressure line.

In order to achieve this object, a fuel pressure control system is described herein for a high pressure fuel injection engine according to a first aspect of the present invention, wherein the high pressure fuel injection engine has a high pressure fuel pump and a high pressure regulator provided in the fuel system, the high pressure line extending between the high pressure fuel pump and the high pressure regulator, a low pressure delivery line extending between a fuel tank and the high pressure fuel pump, a low pressure return line extending between the high pressure regulator and the fuel tank, a feed pump provided in the low pressure delivery line and delivering fuel to the high pressure fuel pump, and an injector communicating with the high pressure line for directly injecting fuel into a combustion chamber. The system comprises means for detecting a degree of impact and control means for stopping the operation of the feed pump and for opening the high regulator when the degree of impact exceeds a set value.

In order to achieve this object, the fuel pressure control system is described herein for the high pressure fuel injection engine according to a second aspect of the present invention, wherein a high pressure fuel injection engine has a high pressure fuel pump and a high pressure regulator provided in the fuel system, a high pressure line extending between the high pressure fuel pump and the high pressure regulator, a low pressure delivery line extending between a fuel tank and the high pressure fuel pump, a low pressure return line extending between the high pressure regulator and the fuel tank, a feed pump provided in the low pressure delivery line and delivering fuel to the high pressure fuel pump, and an injector communicating with the high pressure line for directly injecting fuel into a combustion chamber, the system comprising means for detecting a degree of impact, a relief line extending between the high pressure line and the low pressure line and bypassing the high pressure regulator, line switching means provided in the relief line and control means causing the line switching means to open the relief line and the feed pump to stop when the degree of impact exceeds a set value.

In order to achieve this object, a fuel pressure control system is described herein for a high pressure fuel injection engine according to a third aspect of the present invention, wherein a high pressure fuel injection engine has a high pressure fuel pump and a high pressure regulator provided in fuel system, a high pressure line extending between the high pressure fuel pump and the high pressure regulator, a low pressure delivery line extending between a fuel tank and the high pressure fuel pump, a low pressure return line extending between the high pressure regulator and the fuel tank, a feed pump provided in the low pressure delivery line and delivering fuel to the high pressure fuel pump, and an injector communicating with the high pressure line for directly injecting fuel into a combustion chamber, the system comprising means for detecting a degree of impact, switching means provided in the low pressure delivery line upstream of the feed pump, a check valve provided in the low pressure return line and allowing fuel to return from the low pressure return line to the fuel tank, and control means causing the switching means to close the low pressure delivery line, the high pressure regulator to be fully opened and the feed pump to stop, when the degree of impact detected by the means for detecting a degree of impact exceeds a set value.

In order to achieve this object, a fuel pressure control system for a high pressure fuel injection engine according to a fourth aspect of the present invention comprises an air-bag sensor as the means for detecting a degree of impact of the fuel pressure control systems for high pressure fuel injection engine according to the first, second and third aspects of the present invention, the airbag sensor turning on an igniter mounted to an inflator of an air bag unit.

The fuel pressure control system for high pressure fuel injection engine according to the first aspect of the present invention stops the operation of the feed pump to halt fuel delivery to the high pressure fuel pump and fully opens the high pressure regulator when determining that a degree of impact detected by the means for detecting a degree of impact when the car body receives a strong impact exceeds the set value. Therefore, the fuel pressure in the high pressure line is relieved to the fuel tank through the high pressure regulator before the impact on the car body causes damage in fuel system.

The fuel pressure control system for the high pressure fuel injection engine according to the second aspect of the present invention causes the line switching means to bypass the high regulator and open the relief line extending between the high pressure line and the return line and halt operation of the feed pump to stop the fuel delivery to the high pressure fuel pump when determining that the degree of impact on the car body detected by the impact detecting means exceeds the set value pressure in the high pressure line is relieved to the fuel tank through the relief line. As a result, the fuel pressure in the high pressure line has already approached the atmospheric pressure when the impact on the car body damages the high pressure line.

The fuel pressure control system for the high pressure fuel injection engine according to the third aspect of the present invention stops the operation of the feed pump to halt delivery of fuel to the high pressure fuel pump, causes the switching means provided upstream of the feed pump to close the low pressure delivery line and fully open the high pressure regulator, when determining that a degree of impact detected by the impact detecting means exceeds the set value. Therefore, the fuel pressure in the high pressure line is relieved from the high pressure regulator to the fuel tank. In addition, the switching means and the check valve prevent a vapor pressure from passing out of the fuel tank into the fuel system to suppress the vapor pressure from blowing fuel out of the damaged part.

The fuel pressure control system for high pressure fuel injection engine according to the fourth aspect of the present invention employs the air-bag sensor as the means for detecting a degree of impact of the fuel pressure control systems for high pressure fuel injection engine according to the first, second and third aspects of the present invention, so that the fuel pressure in the high pressure line is reduced immediately after the air bag unit operates.

DESCRIPTION OF THE PREFERRED EMBODIMENTS

Embodiments of the present invention will be described with reference to the drawings hereinafter.

Figure 1:
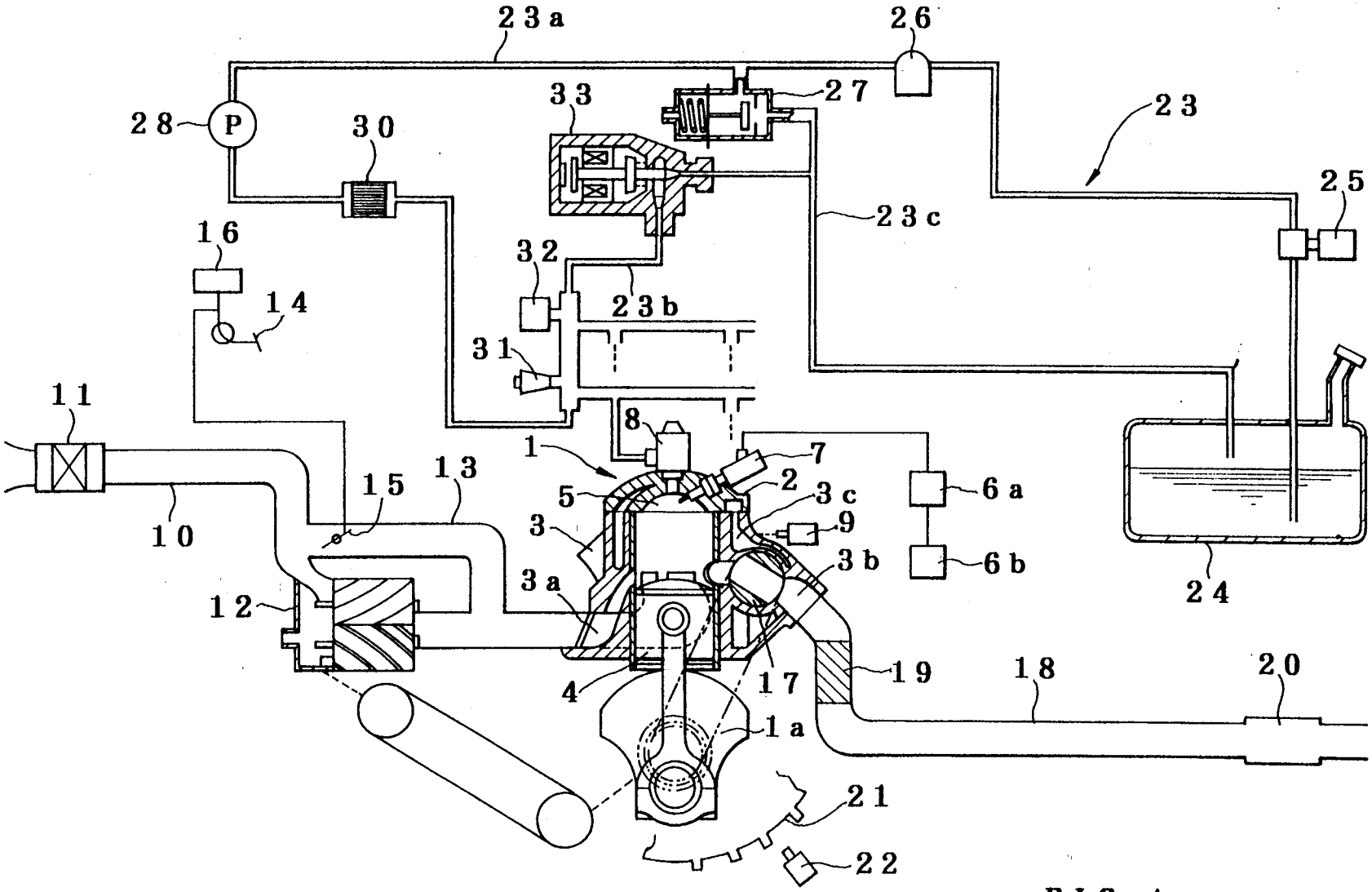
FIG. 1 is a diagrammatic view of an engine control system according to a first embodiment of the present invention.
Figure 2:
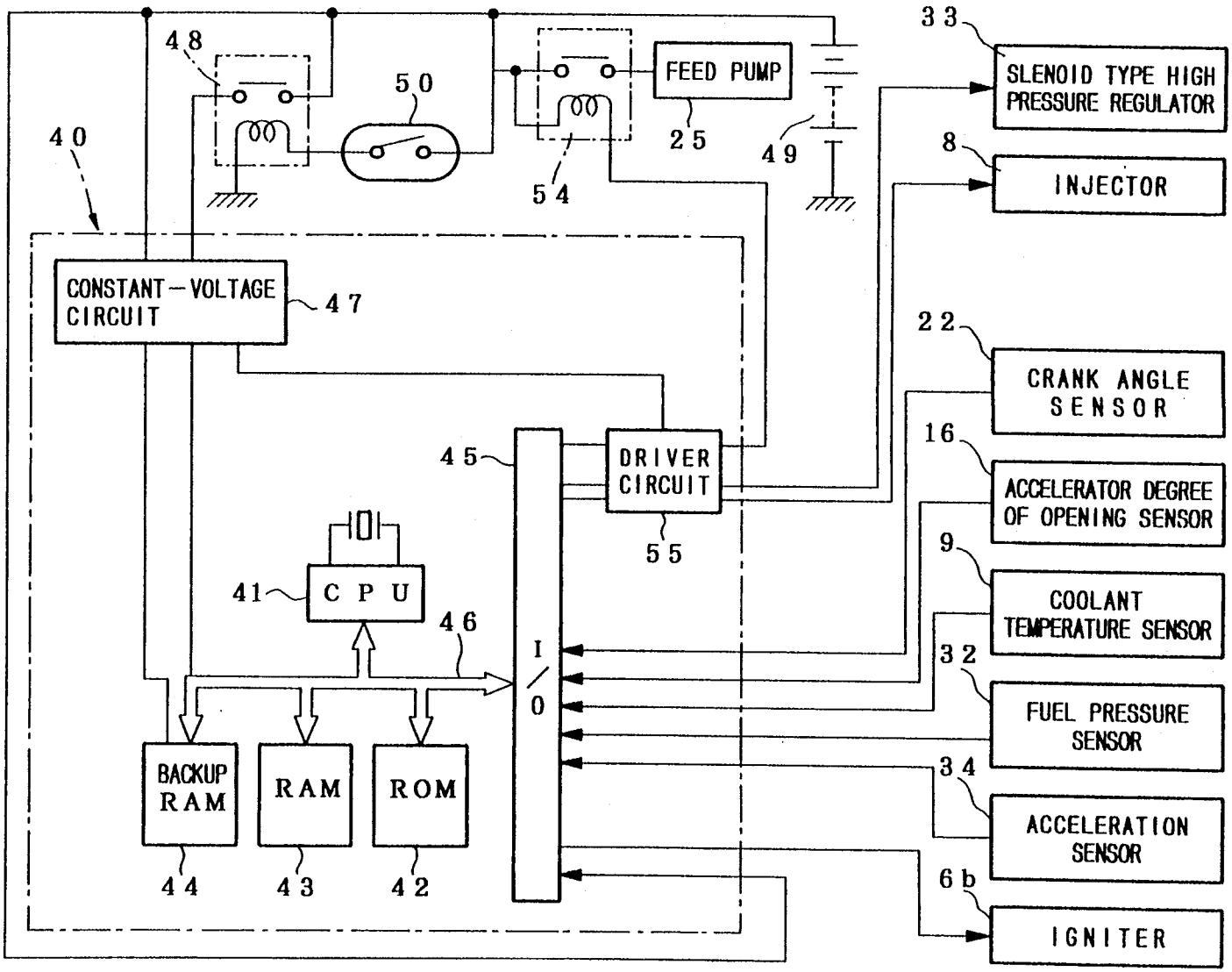
FIG. 2 is a block diagram of the engine control system according to the first embodiment.
Figure 3:
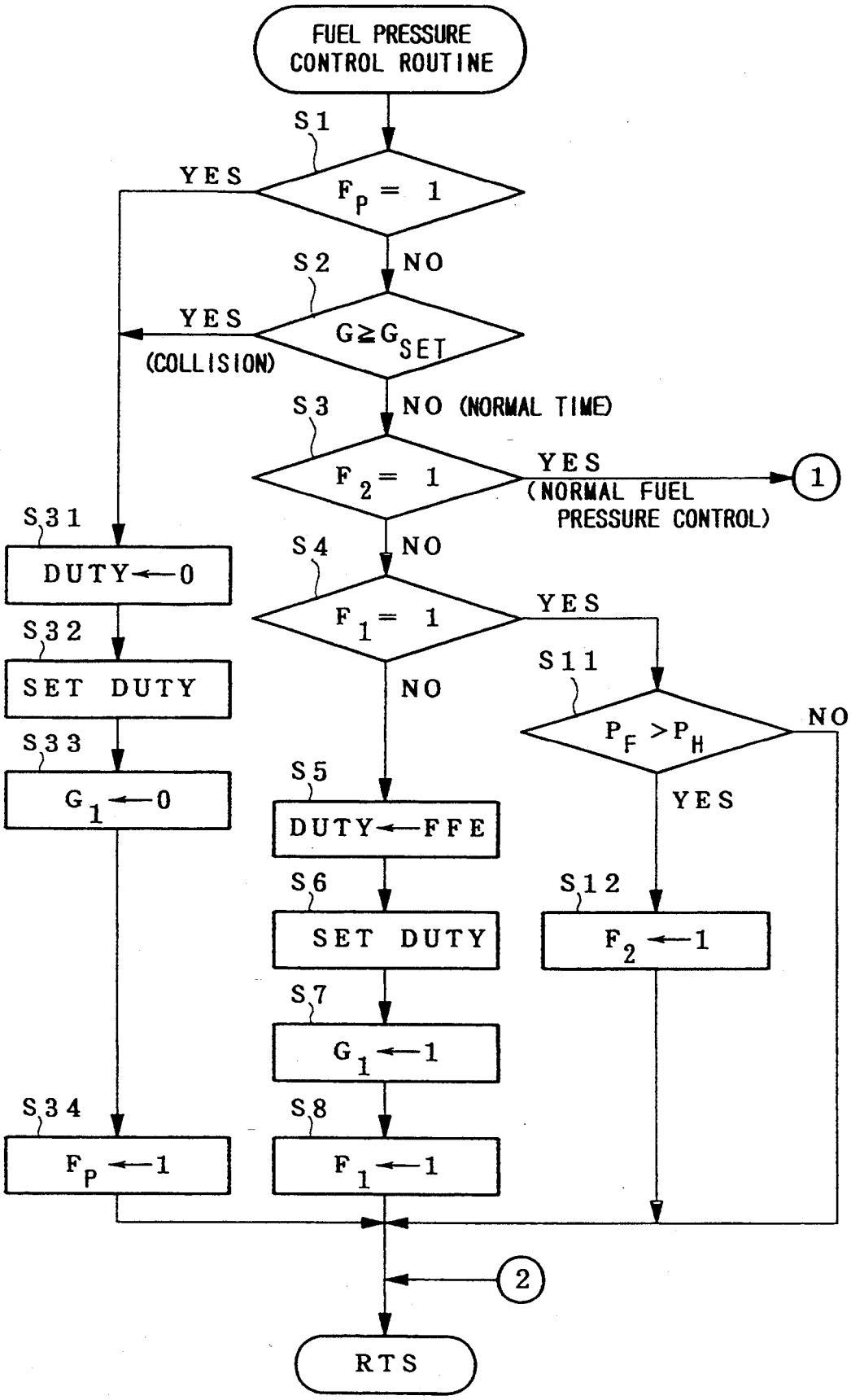
FIG. 3 is a flowchart indicative of a fuel pressure control routine according to the first embodiment.
Figure 4:
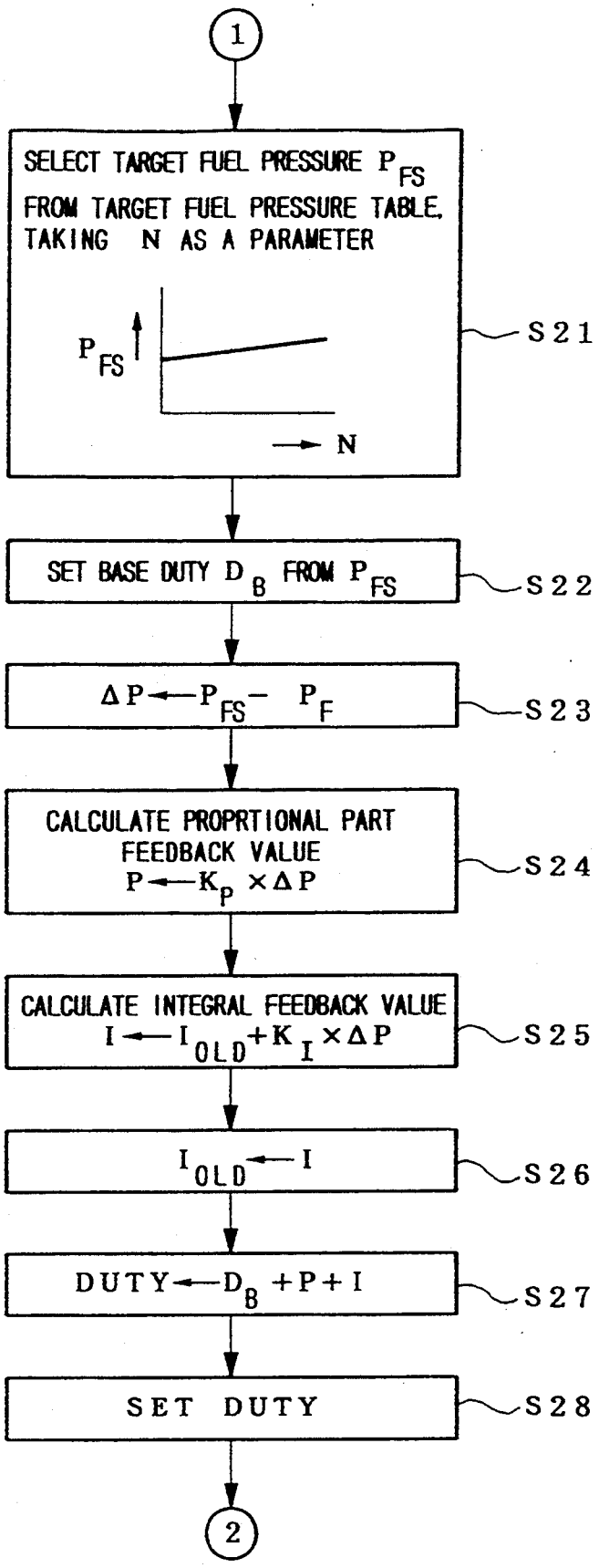
FIG. 4 is a flowchart indicative of the fuel pressure control routine according to the first embodiment.
Figure 5:
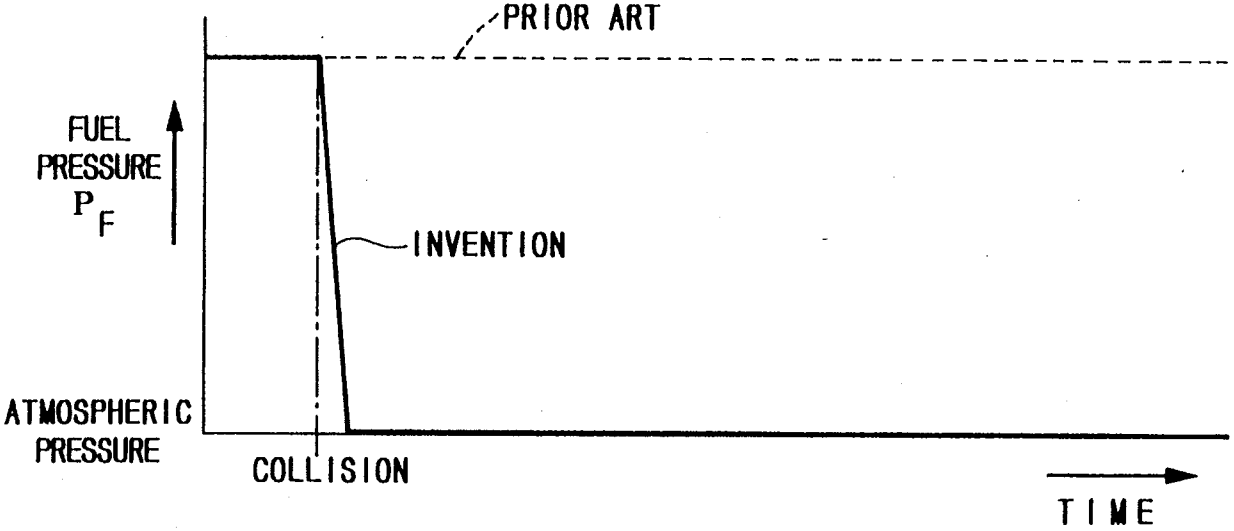
FIG. 5 is a time chart indicative of a temporal change in the fuel pressure in a high pressure line according to the first embodiment when an emergency has happened.

FIGS. 1–5 show a first embodiment of the present invention. FIG. 1 is a diagrammatic view of an engine control system. FIG. 2 is a block diagram of a circuit of an engine control system. FIGS. 3 and 4 are flowcharts indicative of a fuel pressure control routine. FIG. 5 is a time chart indicative of a temporal change in the fuel pressure in a high pressure line when an emergency happens.

Referring to FIG. 1, a high pressure injection engine (in this embodiment, a two-stroke direct fuel injection four-cylinder engine) is indicated at 1. A cylinder head 2, a cylinder block 3 and a piston 4 of the engine 1 define a combustion chamber 5. A spark plug 7 electrically connected to the secondary side of an ignition coil 6*a* and a fuel injector 8 are disposed in the combustion chamber 5. The primary side of the ignition coil 6*a* is electrically connected to an igniter 6*b*.

The cylinder block 3 has a scavenging port 3*a* and an exhaust port 3*b*. A coolant passage 3*c* defined in the cylinder block 3 has a coolant temperature sensor 9 communicating with the interior of the coolant passage 3*c*. An air delivery pipe 10 is fluidly connected to the scavenging port 3*a*. The air delivery pipe 10 has an air cleaner 11 provided upstream thereof and a scavenging pump 12 provided downstream thereof and driven by a crankshaft 1*a*. The scavenging pump 12 supplies fresh air to the combustion chamber 5 and scavenges a burned gas from the combustion chamber 5.

A bypass 13 bypassing the scavenging pump 12 has a bypass control valve 15 provided in the bypass 13 and operatively linked with an accelerator pedal 14. The accelerator pedal 14 has an opening sensor 16 coupled therewith for detecting an accelerator degree.

The exhaust port 3*b* has a rotary exhaust valve 17 mounted therein and physically interlocked with the crankshaft 1*a*. An exhaust pipe 18 is joined to the exhaust port 3*b*. The exhaust pipe 18 has a catalytic converter 19 mounted upstream thereof and a muffler 20 provided downstream thereof.

A crank rotor 21 is coupled coaxially with the crankshaft 1*a* mounted on the cylinder block 3. A crank angle sensor 22 comprising an electromagnetic pickup or the like is opposite to the edge surface of the outer periphery of the crank rotor 21.

A fuel system is indicated at 23. The fuel system comprises a high pressure fuel pump 28 provided therein and a solenoid type high pressure regulator 33 provided downstream of the high pressure fuel pump 28.

A portion of the fuel system 23 upstream of the high pressure fuel pump 28 constitutes a low pressure delivery line 23*a* for delivering fuel out of a fuel tank 24. Another portion of the fuel system 23 extending between the discharge Side of the high pressure fuel pump 28 and the high pressure regulator 33 constitutes a high pressure line 23*b* for pressurizing and delivering the fuel from the low pressure delivery line 23*a* to the injector 8. The other portion of the fuel system 23 downstream of the high pressure regulator 33 constitutes a low pressure return line 23*c*.

In the low pressure delivery line 23*a*, a feed pump 25 delivers fuel out of the fuel tank 24 to the high pressure fuel pump 28 through a fuel filter 26. A diaphragm type low pressure regulator 27 provided downstream of the fuel filter 26 regulates the fuel pressure in the low delivery line 23*a*.

In the high pressure delivery line 23*b*, the high pressure fuel pump 28 pressurizes fuel from the low pressure delivery line 23*a* and delivers high pressure fuel the pressure of which is regulated by the high pressure regulator 33 to the injector 8 of each cylinder through a fuel feed line. The fuel feed line has a high pressure fuel filter 30 provided therein, an accumulator 31 connected thereto and buffering a pulsation in high pressure fuel, and a fuel pressure sensor 32 connected thereto.

The high pressure fuel pump 28 is, for example, an engine-driven pump. The respective intake port and discharge port of the high pressure fuel pump 28 have check valves. When engine stops, the high pressure fuel pump 28 allows fuel from the low pressure delivery line 23*a* to pass therethrough.

The low pressure return line 23*c* returns fuel which is discharged from the diaphragmatic low pressure regulator 27 and the high pressure regulator 33 for regulating the pressure to the fuel tank 24.

In the first embodiment, the high pressure regulator 33 is a normally-open type which reduces an opening degree of the valve as an ON-duty of the high pressure regulator 33 is increased so as to increase the fuel pressure in the high pressure line 23*b*. When the ON-duty is 100%, the high pressure regulator 33 is fully closed.

Referring to FIG. 2, an electronic control unit (ECU) 40 as a control means is a microcomputer or the like. The microcomputer comprises a CPU 41, a ROM 42, a RAM 43, a backup RAM 44, an I/O interface 45, and a bus line 46.

The ECU 40 comprises a constant-voltage circuit 47 having two parallel terminals one of which is connected to a battery 49 through a relay contact of an ECU relay 48 and the other of which is Connected directly to the battery 49. A relay coil of the ECU relay 48 is connected to the battery 49 through an ignition switch 50. The constant-voltage circuit 47 stabilizes the voltage of the battery 49 and supplies the stabilized voltage to the ECU 40 when the ignition switch 50 is turned on to close the contact of the ECU relay 48. On the other hand, the constant-voltage circuit 47 continuously supplies a backup power to the backup RAM 44 even when the ignition switch 50 is turned off to open the contact of the ECU relay 48.

A feed pump 25 is connected to the battery 49 through a contact of a feed pump relay 54.

An input port Of the I/O interface 45 is connected to the battery 49 in order to monitor the battery voltage. The input port of the I/O interface 45 is also connected to the crank angle sensor 22, the accelerator degree of opening sensor 16, the coolant temperature sensor 9, the fuel pressure sensor 32 and an acceleration sensor 34 which is mounted on a car body, for detecting a degree of an impact to the car body as an accelerations G.

An output port of the I/O interface 45 is connected to the igniter 6*b* driving the ignition coil 6*a*. The output port of the I/O interface 45 is also connected to a relay coil of a feed pump relay 54 to which the battery 49 supplies power, the injector 8 and the high pressure regulator 33 through a driver circuit 55.

A flowchart of FIGS. 3 and 4 indicates a fuel pressure control routine of the ECU 40. When the ignition switch 50 is turned on to supply power to the ECU 40, the system is initialized (i.e., flags other than a fuel pressure reduction flag $F_P$ are cleared and the I/O port output values are 0).

This fuel pressure control routine is executed at an interval of a predetermined period of time after the system is initialized. At step S1, it is determined whether the fuel pressure reduction flag $F_P$ has been set. At step S2, it is determined whether the output value (acceleration) G of the acceleration sensor 34 exceeds a set value $G_{SET}$. At step S3, it is determined whether a normal control transition flag F2 has been set. At step S4, it is determined whether an initialization completion flag F1 has been set. The backup RAM 44 stores only a fuel pressure flag $F_P$. The initial set value of the fuel pressure flag $F_P$ is 0. When the fuel pressure control routine is first executed, the flags $F_P$, F2 and F1 have been already cleared. In addition, since a car is in a stopped position, the acceleration G is 0. Therefore, a fuel pressure control process proceeds to step S5.

At step S5, the process sets the ON-duty of the high pressure regulator 33 to be FFH (i.e. 100%). At step S6, the process sets FFH to be an I/O port output value to the high pressure regulator 33. Subsequently, the process proceeds to step S7, where it sets an I/O port output value G1 to the relay coil of the feed pump relay 54 to be 1. At step S8, the process sets the initialization completion flag F1. Subsequently, the process exits the routine.

Once at step S6 the ON-duty of the high pressure regulator 33 is set robe FFH, the high pressure regulator 33 is fully closed. In addition, once the I/O port output value G1 to the relay coil of the feed pump relay 54 is set to be 1, the feed pump relay 54 is turned on and the feed pump 25 starts delivering fuel to the high pressure fuel pump 28. If the high pressure fuel pump 28 is an engine-driven type, it starts delivering fuel after engine starts.

In a second execution of the routine, since the initialization completion flag F1 has been set to be 1 through the first execution of the routine, the process proceeds through steps S1 to S3 to step S4, where it proceeds to step S11. At step S11, it is determined whether the fuel pressure PF in the high pressure line 23*b* has exceeded a set pressure $P_H$ (for example, $9.8\times10^3$ Kpa).

If $P_F \leqq P_H$ at step S11, the process exits the routine. In a subsequent execution of the routine, once the fuel pressure $P_F$ exceeds the set pressure $P_H$ (i.e. $P_F > P_H$), the process proceeds from step S11 to step S12, where it sets the normal control transition flag F2. Subsequently, the process exits the routine.

In a subsequent execution of the routine, since the normal control transition flag F2 has been set, the process proceeds through steps S1 to S3 to step S21, where the process proceeds to a normal fuel pressure control of feedback controlling fuel pressure.

In the normal fuel pressure control, at step S21, the process selects a target fuel pressure $P_{FS}$ from a target fuel pressure table, taking engine speed N as a parameter. The target fuel pressure table contains optimum fuel pressures empirically obtained for engine speeds N in view of engine characteristics and fuel pump noise. As shown in step S21 of the flowchart of FIG. 4, the target fuel pressure is increased as engine speed N is increased. The ROM 42 stores tabled target fuel pressures in addresses.

Next, the process proceeds from step S21 to step S22, where taking the target fuel pressure $P_{FS}$ as a parameter it sets a base controlled variable (i.e. a base duty $D_B$) for the high pressure regulator 33 on the basis of a predetermined base control table or function. At step S23, the process calculates a deviation $\Delta P$ between the target fuel pressure $P_{FS}$ and the fuel pressure $P_F$ ($\Delta P \leftarrow P_{FS} - P_F$). Subsequently, the process proceeds to step S24.

At step S24, the process calculates a proportional part feedback value P by multiplying a proportional constant $K_P$ in proportional-plus-integral control and the deviation $\Delta P$ ($P \leftarrow K_P \times \Delta P$). At step S25, the process adds a last-time integral feedback value $I_{OLD}$ read from the RAM 43 to a value obtained from a multiplication of an integral constant $K_1$ in proportional-plus-integral control and the deviation $\Delta P$. The process obtains a new integral feedback value I ($I \leftarrow I_{OLD} + K_I \times \Delta P$).

At step S26, the process updates the last integral feedback value $I_{OLD}$ stored in the RAM 43 with the integral feedback value I. At step S27, the process adds the proportional feedback value P and the integral feedback value I to the base duty $D_B$ for the ON-duty DUTY (i.e. a controlled feedback variable) of the high pressure regulator 33 ($DUTY \leftarrow D_B + P + I$). At step S28, the process sets the ON-duty. Subsequent to step S28, the process exits the routine. Thus, the fuel pressure $P_F$ is feedback controlled to follow up the target fuel pressure $P_{FS}$.

On the other hand, once the car body receives a strong impact derived from a collision of a travelling car, the output value G of the acceleration sensor 34 mounted to the car body is rapidly increased. At step S2, the process determines whether the output value G has reached or exceeded the set value $G_{SET}$. If $G \geqq G_{SET}$, the process determines that an emergency such as a collision happened and proceeds to step S31. An acceleration when the car body receives a strong impact from a collision is empirically obtained. The set value $G_{SET}$ is set on the basis of this acceleration.

At step S31, the process sets the ON-duty DUTY of the high pressure regulator 33 to be 0 (%). At step S32, the process sets the value of 0 (%) to be the I/O port output value to the high pressure regulator 33. Subsequently, the process proceeds to step S33, where it sets the I/O port output value G1 to the relay coil of the feed pump relay 54 to be 0. Subsequently, the process proceeds to step S34, where it sets the fuel pressure reduction flag $F_P$ stored in the backup RAM 44. Subsequently, the process exits the routine.

In a subsequent execution of the routine, since the fuel pressure reduction flag $F_P$ has been set, the process proceeds from step S1 to step S31 and executes step S31 through step S34 as described above. After step S34, the process exits the routine. The process repeats the execution of the routine until the ECU 40 is de-energized.

At step S32, once the I/O port output value DUTY to the high pressure regulator 33 is set to be 0 (%), the high pressure regulator 33 is fully opened because of the normally-open type of the high pressure regulator 33. At step S33, once the I/O port output value G1 to the relay coil of the feed pump relay 54 is set to be 0, the feed pump relay 54 is turned off to stop the operation of the feed pump 25.

Once the feed pump 25 stops, the fuel delivery to the high pressure fuel pump 28 is stopped. On the other hand, since the high pressure regulator 33 is in a fully opened position, the fuel pressure $P_F$ in the high pressure line 23*b* of fuel system 23 is relieved to the fuel tank through the high pressure regulator 33 and the low pressure return line 23*c*.

Thus, as shown in solid line in FIG. 5, the fuel pressure $P_F$ in the high pressure line 23*b* is rapidly reduced to the atmospheric pressure when the acceleration sensor 34 detects a strong impact such as a collision. Thus, since the fuel pressure $P_F$ is already reduced when the fuel system 23 is damaged from the strong impact on the car body, the fuel pressure control system prevents fuel from blowing out of the damaged part in fuel system 23. On the other hand, as shown in dotted line in FIG. 5, a prior-art fuel pressure control system maintains the fuel pressure $P_F$ in the high pressure line 23*b* to be high, so that fuel blows out of a damaged part in fuel system 23. In other words, since the fuel pressure control system predicts a possible damage in fuel system 23 and rapidly reduces the fuel pressure in the high pressure line 23*b*, it can prevent a fuel blowout from the damaged part.

Since the high pressure regulator 33 is a normally-open type, the high pressure regulator 33 remains fully opened and the feed pump 25 remains stopped, the fuel pressure $P_F$ remains in the atmospheric pressure after the acceleration sensor 34 detects a strong impact ($G \geqq G_{SET}$) such as a collision.

On the other hand, even if a driver inadvertently turns on the ignition switch 50 again to switch on the ECU 40, the fuel pressure $P_F$ in the high pressure line 23*b* remains in the atmospheric pressure since the process executes steps S31 to S34. Thus, the fuel pressure control system prevents fuel from blowing out of a damaged part in fuel system.

After checking and repairing a car brought into a service station of a car dealer etc., as disclosed in Japanese unexamined patent application publication HEI.1-224636, the fuel pressure reduction flag $F_P$ is cleared (i.e. initialized), when a repairman connects a vehicle diagnostic system to a connector (not shown) of the ECU 40 and enters a predetermined operational input to the vehicle diagnostic system or when the repairman opens the connecting terminal between the ECU 40 and the battery 49 to switch off a power supply to the backup RAM 44.

Figure 6:
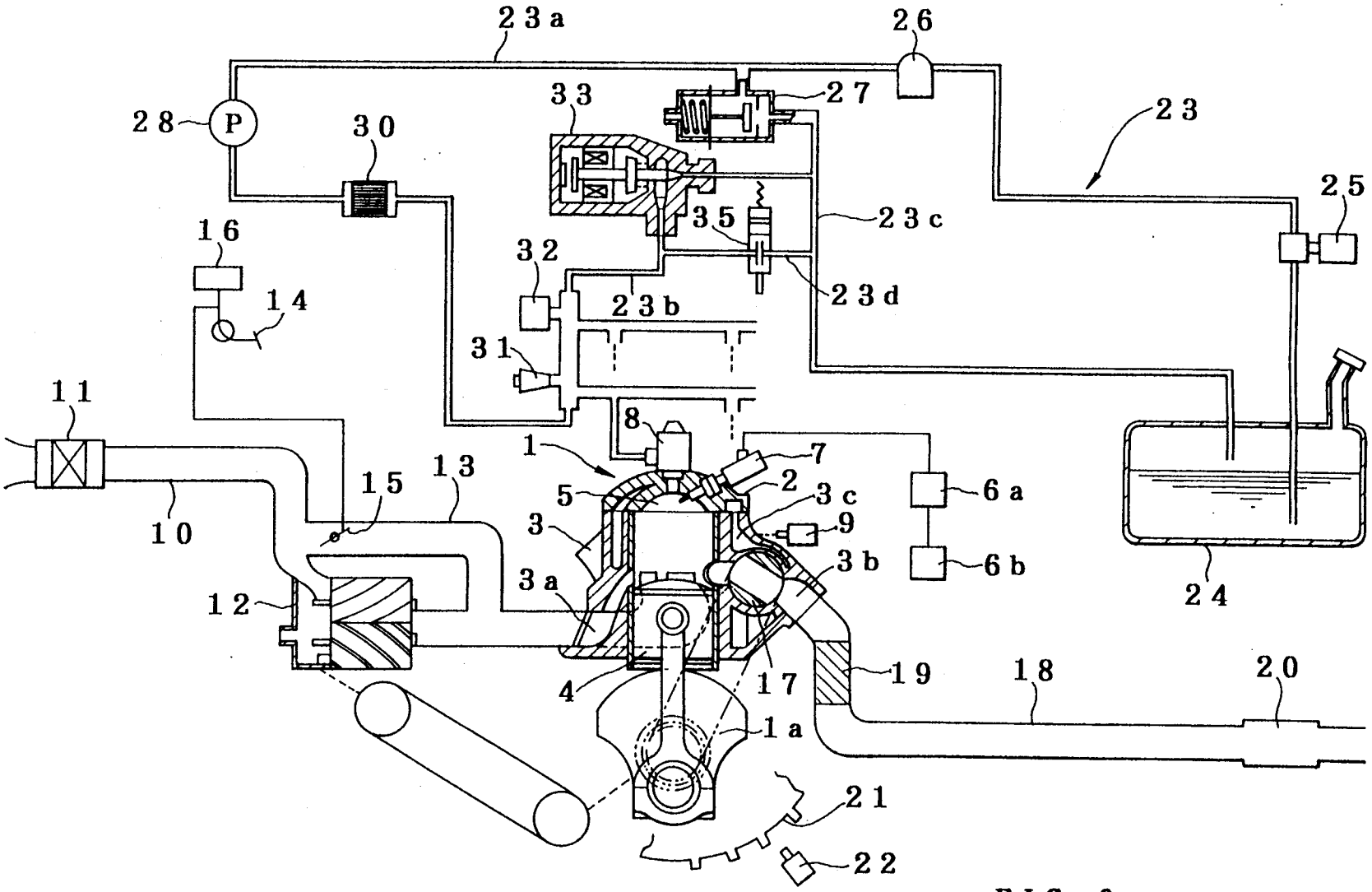
FIG. 6 is a diagrammatic view of the engine control system according to a second embodiment of the present invention.
Figure 7:
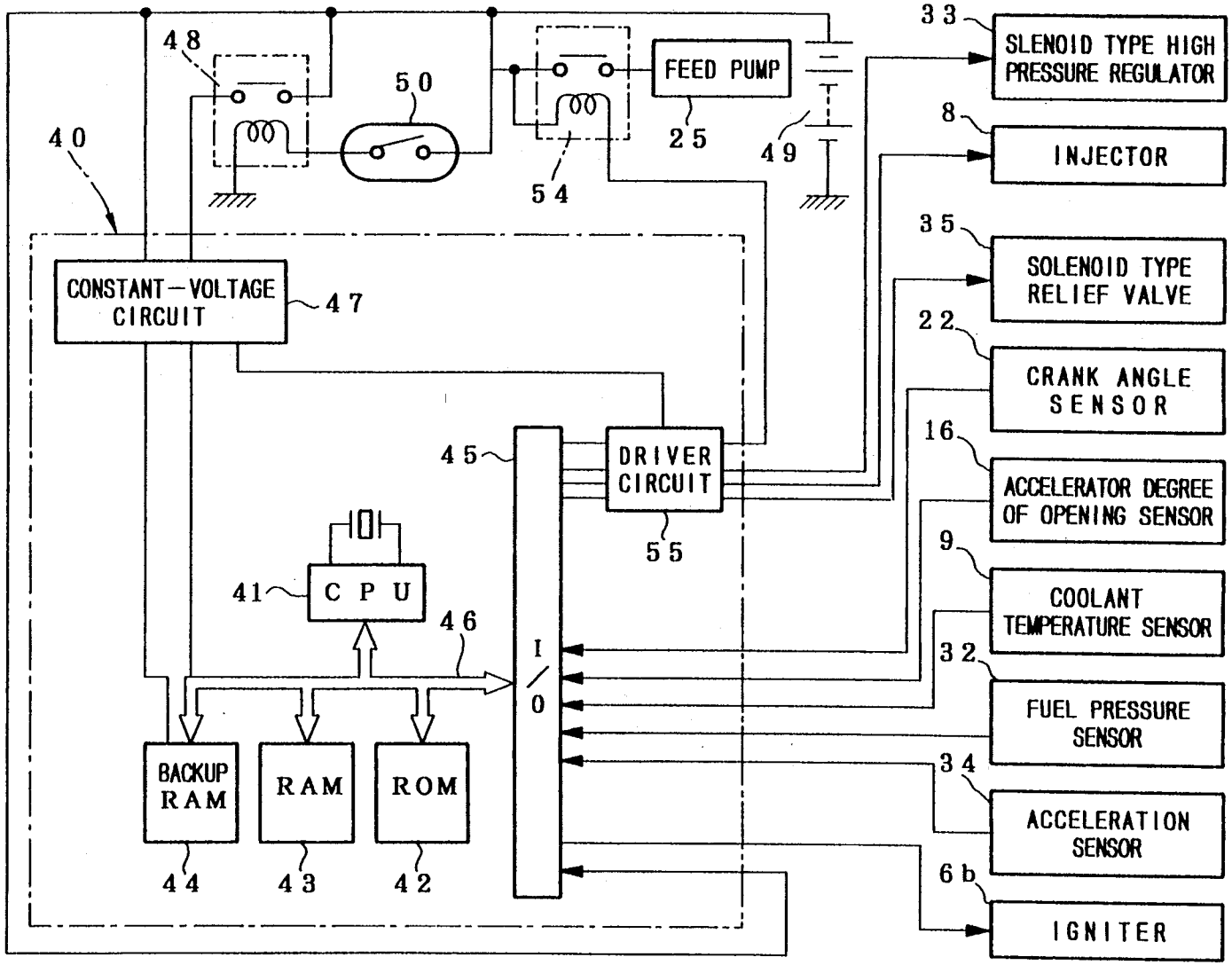
FIG. 7 is a block diagram of the engine control system according to the second embodiment.
Figure 8:
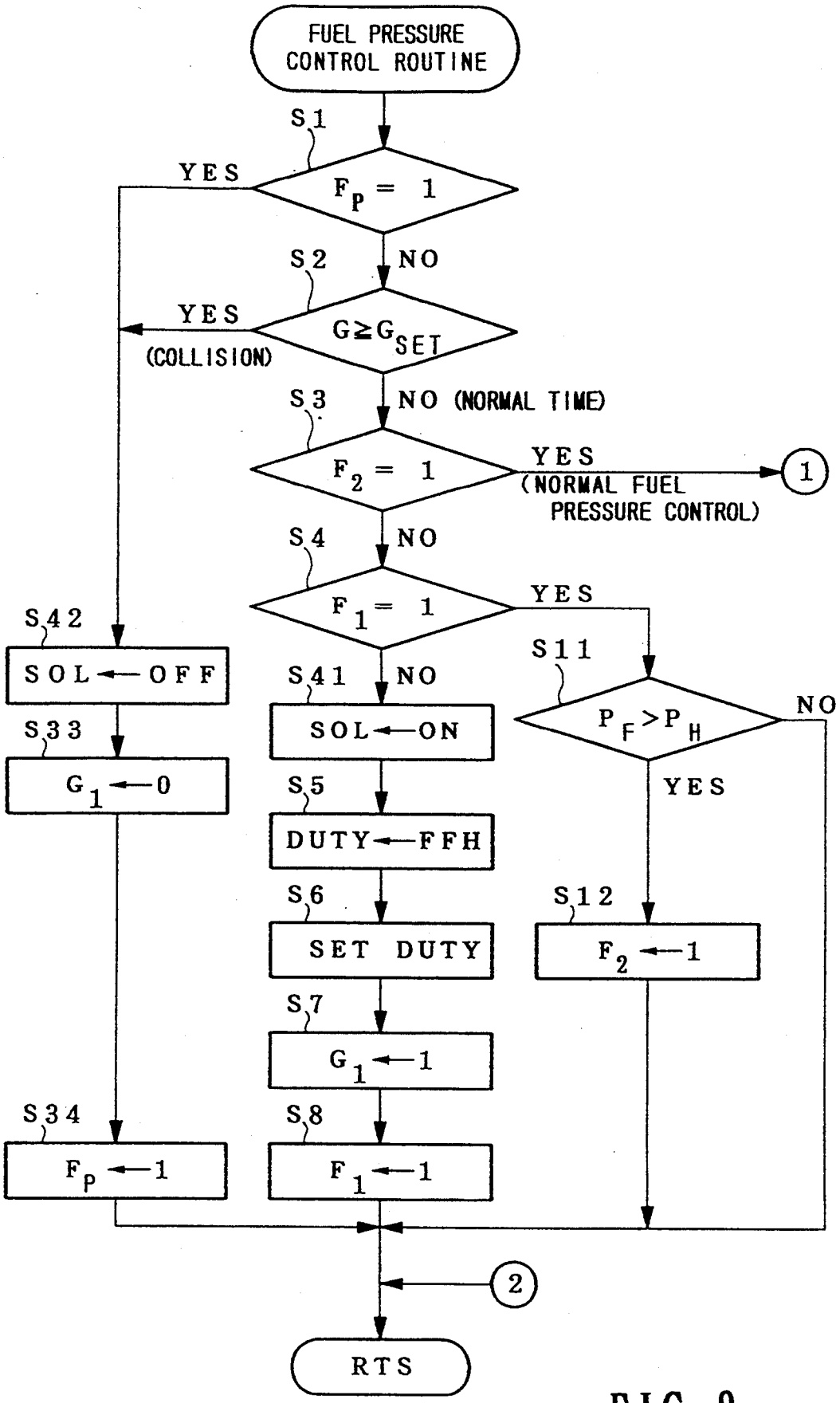
FIG. 8 is a flowchart indicative of the fuel pressure control routine according to the second embodiment.

FIGS. 6–8 show a second embodiment according to the present invention. FIG. 6 is a diagrammatic view of an engine control system. FIG. 7 is a block diagram of a circuit of a control system. FIG. 8 is a flowchart indicative of a fuel pressure control routine. The same or similar components and steps of the second embodiment as those of the first embodiment have the same reference numerals. The same descriptions will not be repeated hereinafter.

In the second embodiment, as shown in FIG. 6, the fuel system 23 comprises a relief line 23*d* extending between the high pressure line 23*b* and the low pressure return line 23*c* and bypassing the high pressure regulator 33. The relief line 23*d* comprises a selector valve type solenoid relief valve 35 as a line changeover means. The relief valve 35 is a normally-open type and closed in response to an ON signal from the ECU 40.

In a first execution of the routine according to the second embodiment, since the system is initialized and a car is in the stopped position after energizing the ECU 40, the process proceeds through step S1, step S2, step S3 and step S4 to step S41, where the solenoid of the relief valve 35 is energized. At steps S5 to S7, the process fully closes the high pressure regulator 33 and starts the feed pump 25 to deliver fuel to the high pressure fuel pump 28. At step S8, the process sets the initialization completion flag F1. Subsequently, the process exits the routine.

Once the solenoid of the relief valve 35 is energized at step S41, the relief valve 35 is closed to close the relief line **23*d*, as shown in FIG. 6**.

In a second execution of the routine according to the second embodiment, since at step S8 the initialization completion flag F1 was set in the first execution of the routine, the process proceeds from step S4 to step S11. At step S11, the process compares the fuel pressure $P_F$ in the high pressure line **23*b* with the set pressure $P_H$ (for example, $9.8\times10^3$ Kpa). The process repeatedly executes the routine until the fuel pressure $P_F$ exceeds the set pressure $P_H$. Once the fuel pressure $P_F$ exceeds the set pressure $P_H$ ($P_F>P_H$), the process proceeds from step S11 to step S12, where it sets the normal control transition flag F2. After step S12**, the process exits the routine.

In a subsequent execution of the routine according to the second embodiment, since the normal control transition flag F2 has been set, the process proceeds from the step S3 to step S21 of the flowchart of FIG. 4 according to the first embodiment. At step S21 and the subsequent steps, the process performs the normal fuel pressure control of feedback controlling the fuel pressure.

On the other hand, once at step S2 the car body receives a strong impact from a collision during the travel of the car and the output value G of the acceleration sensor 34 mounted to the car body equal to or exceeds $G_{SET}$, the process proceeds from step S2 to step S42.

At step S42, the process deenergizes the solenoid of the relief valve 35. At step S33, the process sets the I/O port output value G1 to the relay coil of the feed pump relay 54 to be 0. At step S34, the process sets the fuel pressure reduction flag $F_P$. Subsequently, the process exits the routine.

In a subsequent execution of the routine, since the process has set the fuel pressure reduction flag $F_P$, the process proceeds from step S1 to step S42 and executes steps S42, S33 and S34 as described above. After step S34, the process exits the routine. Thereafter, the process repeats the routine until the ECU 40 is de-energized.

At step S42, once the solenoid of the relief valve 35 is de-energized, the relief valve 35 is opened and the relief line **23*d* bypassing the high pressure regulator 33 is opened. On the other hand, since at step S33 the process sets the I/O port output value G1 to the relay coil of the feed pump relay 54 to be 0 (G1=0), the feed pump relay 54 is turned on to stop the operation of the feed pump 25. Thus, the feed pump 25 stops delivering fuel to the high pressure fuel pump 28**.

Thus, the fuel pressure $P_F$ in the high pressure line **23*b* of fuel system 23 is rapidly relieved to the fuel tank 24 through the relief line 23*d* and the low pressure return line 23*c***.

In the second embodiment, since the fuel pressure control system directly relieves the fuel pressure $P_F$ to the low pressure return line **23*c* without the intervention of the high pressure regulator 33**, the fuel pressure control system provides a reduced passage resistance. Thus, the fuel pressure control system according to the second embodiment can rapidly reduce the fuel pressure $P_F$ to the atmospheric pressure.

Figure 9:
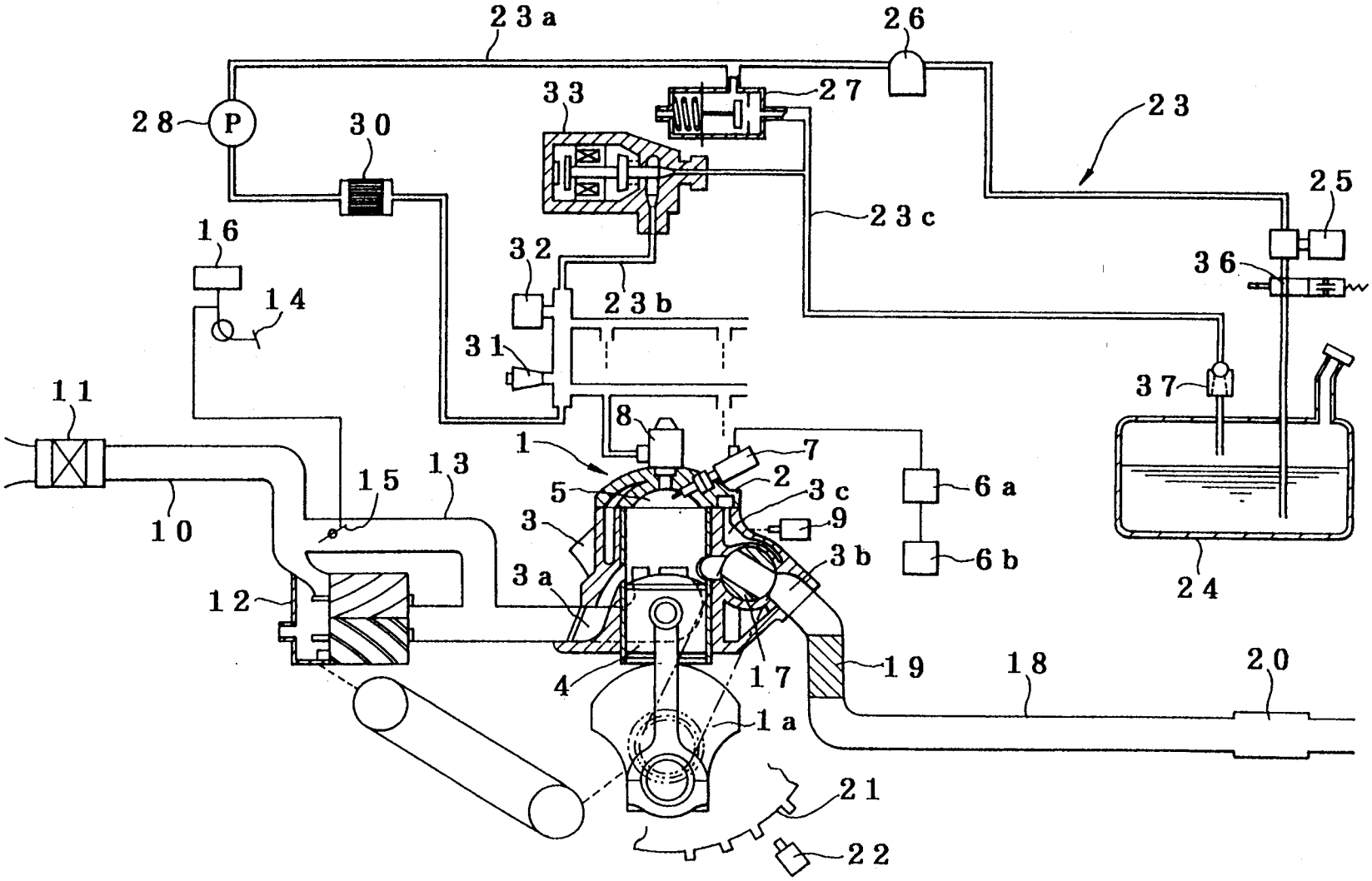
FIG. 9 is a diagrammatic view of the engine control system according to a third embodiment of the present invention.
Figure 10:
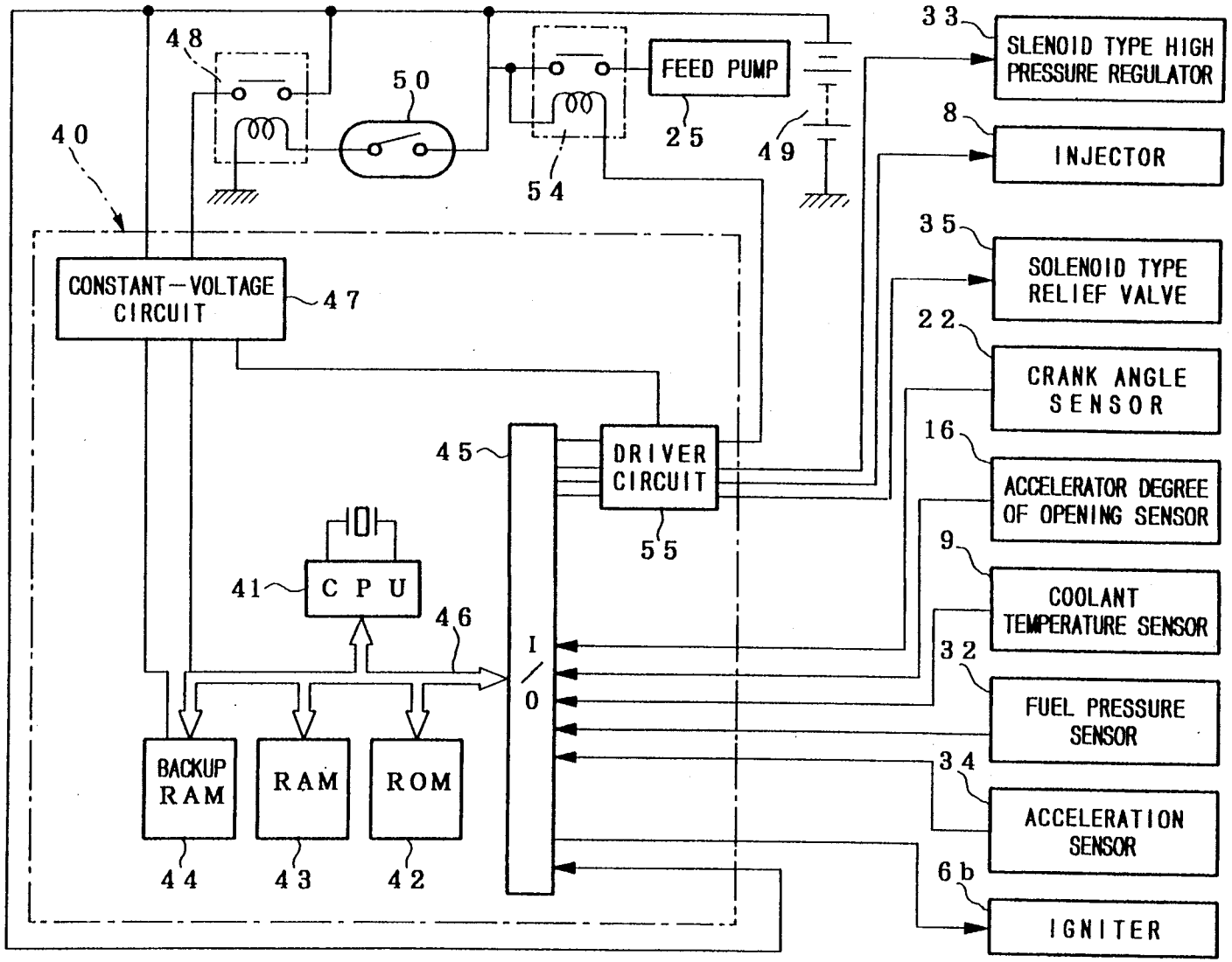
FIG. 10 is a block diagram of the engine control system according to the third embodiment.
Figure 11:
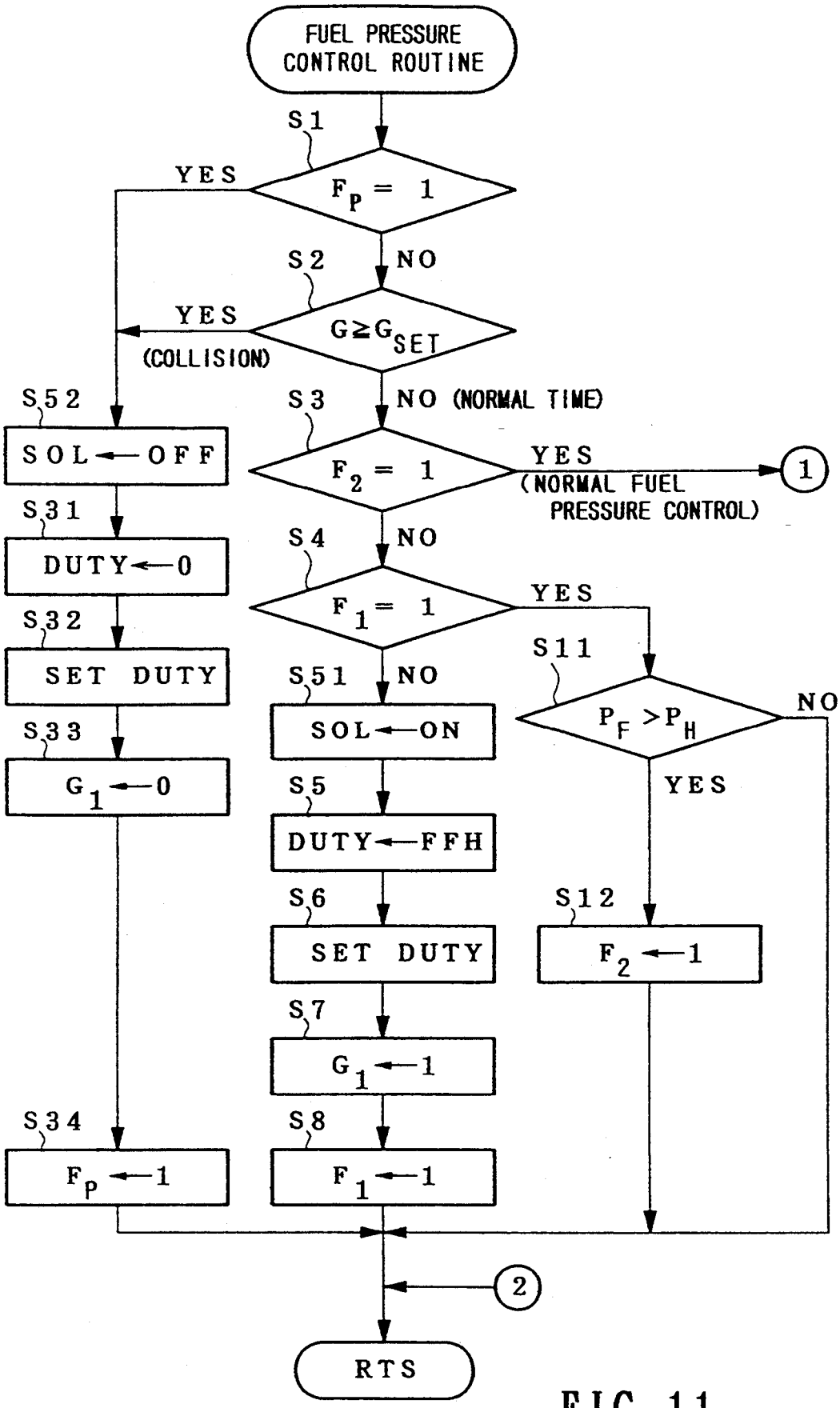
FIG. 11 is a flowchart indicative of the fuel pressure control routine according to the third embodiment.

FIGS. 9–11 show a third embodiment according to the present invention. FIG. 9 is a diagrammatic view of an engine control system. FIG. 10 is a block diagram of a circuit of a control system. FIG. 11 is a flowchart indicative of a fuel pressure control routine. The same or similar components and steps of the second embodiment as those of the first embodiment have the same reference numerals. The same descriptions will not be repeated hereinafter.

In the third embodiment, the low pressure delivery line **23*a* upstream of the feed pump 25 of fuel system 23 has a solenoid type line off valve 36 (a kind of normally-open solenoid type directional control valve) as a switching means and the low pressure return line 23*c* has a check valve 37 provided near the fuel tank 24 and allowing fuel to pass from the high pressure regulator 33 to the fuel tank 24. When the car body receives a strong impact, the solenoid type line off valve 36 is closed to close the low pressure delivery line 23*a* upstream of the feed pump 25. As shown in FIG. 10, the line off valve 36 is opened in response to an ON signal from the ECU 40**.

FIG. 11 shows a fuel pressure control routine according to the third,embodiment. In a first execution of the routine after the ECU 40 is energized, since the system has been initialized and the car is in a stopped position, the process proceeds through steps S1 to S4 to step S51, where an ON signal is provided to the solenoid of the line off valve 36. Thereupon, the line off valve 36 is opened to allow fuel to pass from the fuel tank 24 to the feed pump 25.

At steps S5 to S7, the high pressure regulator 33 is fully closed and the feed pump 25 is operated to start delivering fuel to the high pressure fuel pump 28. At step S8, the initialization completion flag F1 is set. Subsequently, the process exits the routine.

In a second execution of the routine according to the second embodiment, since at step S8 the initialization completion flag F1 was set in the first execution of the routine, the process proceeds from step S4 to step S11. At step S11, the process compares the fuel pressure $P_F$ in the high pressure line **23*b* with the set pressure $P_H$ (for example, $9.8\times10^3$ Kpa). The process repeatedly executes the routine until the fuel pressure PF exceeds the set pressure $P_H$. Once the fuel pressure $P_F$ exceeds the set pressure $P_H$ ($P_F>P_H$), the process proceeds from step S11 to step S12, where it sets the normal control transition flag F2. After step S12**, the process exits the routine.

In a subsequent execution of the routine according to the third embodiment, since the normal control transition flag F2 has been set, the process proceeds from the step S3 to step S21 of the flowchart of FIG. 4 according to the first embodiment. At step S21 and the subsequent steps, the process performs the normal fuel pressure control of feedback controlling the fuel pressure.

On the other hand, once at step S2 the car body receives a strong impact from a collision during the travel of the car and the output value G of the acceleration sensor 34 mounted to the car body equal to or exceeds $G_{SET}$, the process proceeds from step S2 to step S52.

At step S52, the solenoid of the line off valve 36 is turned off. At step S31, the ON-duty of the high pressure regulator 33 is set to be 0 (%). At step S32, this value is set to be the I/O output value to the high pressure regulator 33. Subsequently, the process proceeds to step S33, where the I/O port output value G1 to the relay coil of the feed pump relay 54 is set to be 0. At step S34, the fuel pressure reduction flag $F_P$ is set. Subsequently, the process exits the routine.

In a subsequent execution of the routine, since at step s34 the process has set the fuel pressure reduction flag $F_P$, the process proceeds from step S1 to step S52 and executes steps S52, S31 to S34 as described above. After step S34, the process exits the routine. Thereafter, the process repeats the routine until the ECU 40 is deenergized.

At step S52, once the solenoid of the line off valve 36 is turned off, the line off valve 36 is closed to close the low pressure delivery line 23*a* upstream of the feed pump 25. At step S32, once the I/O port output value DUTY to the high pressure regulator 33 is set to be 0 (%), the high pressure regulator 33 is fully opened because of the normally-open type thereof. At step S33, once the I/O port output value G1 to the relay coil of the feed pump relay 54 is set to be 0, the feed pump relay 54 is turned off to stop the operation of the feed pump 25 to stop delivering fuel to the high pressure fuel pump 28.

Thus, the fuel pressure $P_F$ in the high pressure line 23*b* of fuel system 23 is relieved to the fuel tank 24 through the high pressure regulator 33.

Since the line off valve 36 closes the low pressure delivery line 23*a* upstream of the feed pump 25 and the check valve 37 is mounted to the low pressure return line 23*c* at the downstream end thereof, no fuel vapor pressure passes out of the fuel tank 24 into fuel system 23, i.e., a fuel vapor pressure is confined to the interior of the fuel tank 24. Therefore, the fuel pressure control system prevents fuel from blowing out of a damaged part in fuel system 23 by the check valve 37.

Figure 12:
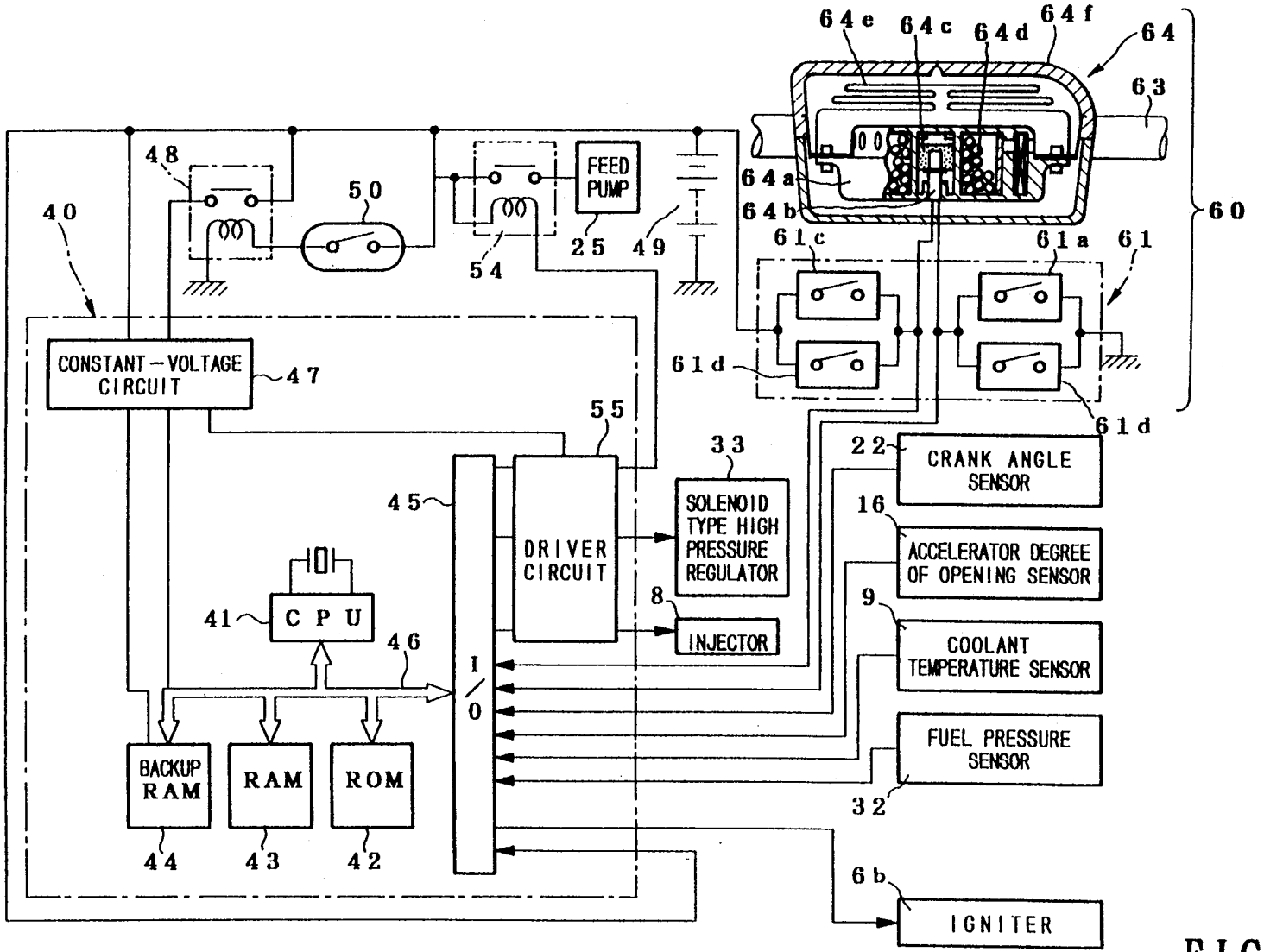
FIG. 12 is a block diagram of the engine control system according to a fourth embodiment.
Figure 13A:
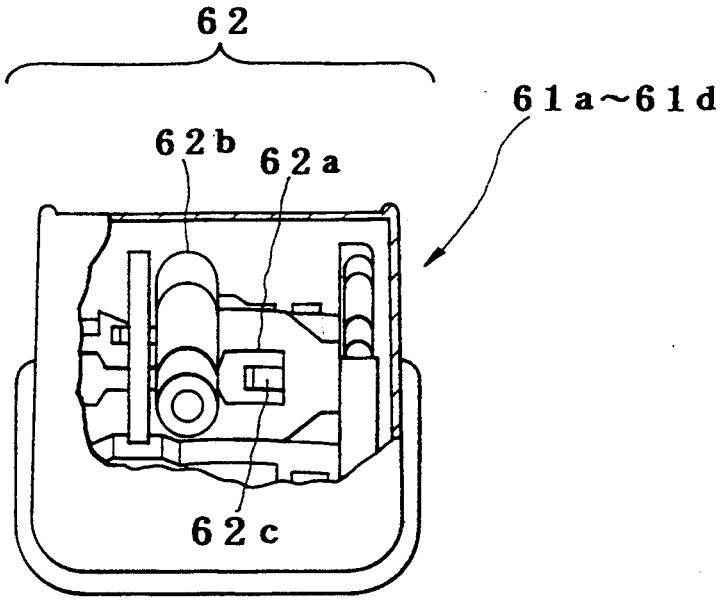
FIG. 13*a* and 13*b* are views of an air-bag sensor according to the fourth embodiment.
Figure 13B:
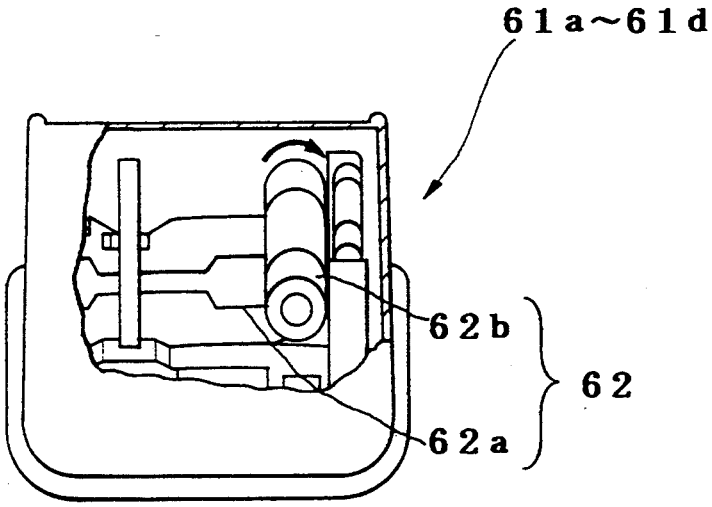
Figure 14:
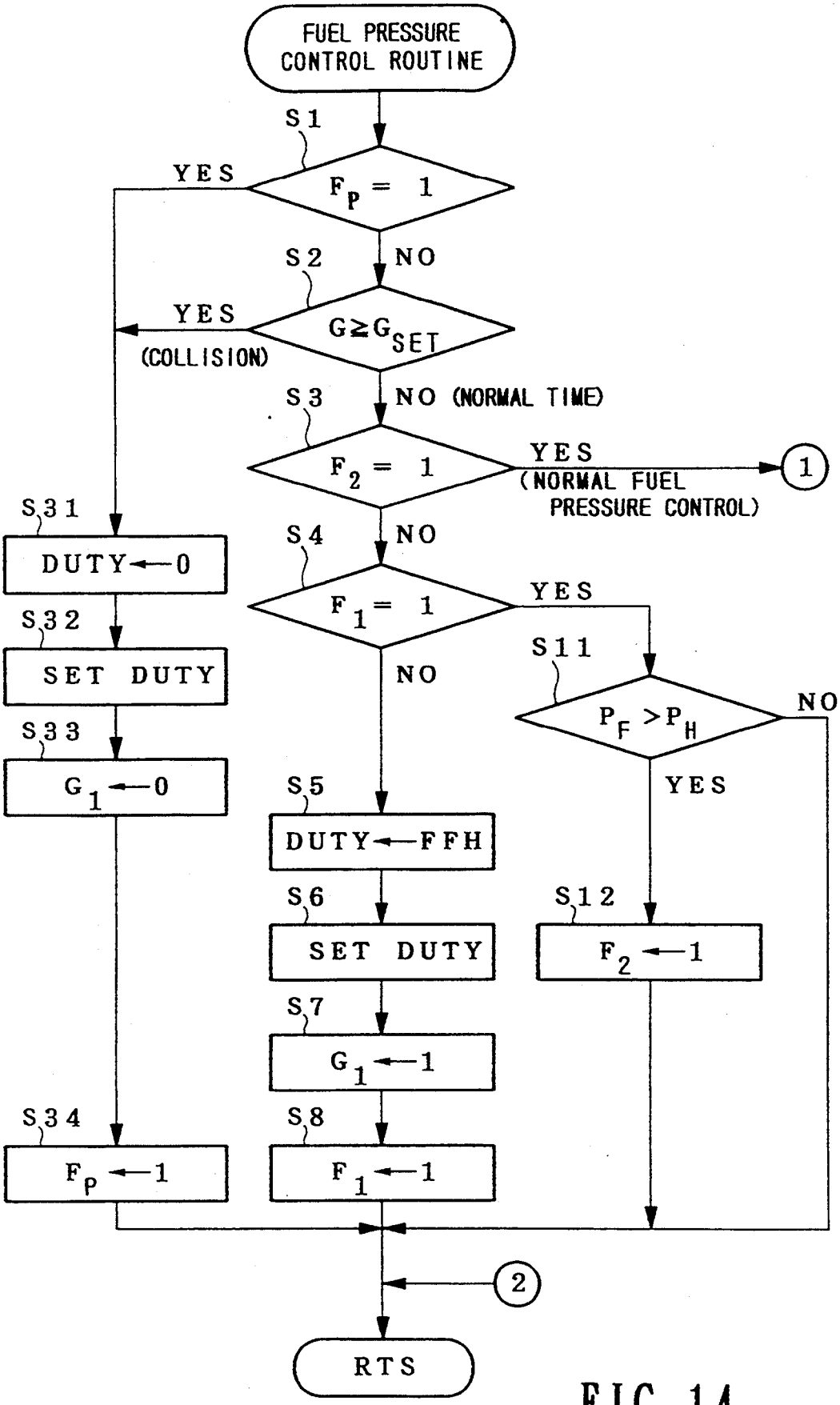
FIG. 14 is a flowchart indicative of the fuel pressure control routine according to the fourth embodiment.

FIGS. 12–14 show a fourth embodiment of the present invention. FIG. 12 is a block diagram of a circuit of a control system according to the fourth embodiment. FIG. 13 is a view of states off an air-bag sensor. FIG. 14 is a flowchart indicative of a fuel pressure control routine according to the fourth embodiment. The same or similar components and steps of the second embodiment as those of the first embodiment have the same reference numerals. Descriptions of those will not be repeated hereinafter.

In the fourth embodiment, an air-bag sensor 61 of an air bag unit 60 detects an impact on a car body instead of the acceleration sensor 34 in the first embodiment.

As shown in FIG. 12, the air bag unit 60 comprises the air-bag sensor 61 and an air bag module 64 mounted to a steering wheel 63. The air-bag sensor 61 comprises two front sensors 61*a* and 61*b* respectively mounted to, for example, the front ends of opposite side frames within a fender of a car body, and two safing sensors 61*c* and 61*d* mounted to a room side front end of a front tunnel.

As shown in FIG. 13, each of the sensors 61*a*, 61*b*, 61*c* and 61*d* comprises a rollermite-type sensor body 62 mounted within a casing and comprising a roll spring 62*a* and a roller 62*b*. When each sensor 61*a* to 61*d* receives a strong impact from the front during a collision, the roller 62*b* is rotated to turn on the switch 62, as shown in FIG. 13(*b*).

The front sensors 61*a* and 61*b* are connected in parallel to each other. The pair of safing sensors 61*c* and 61*d* is connected to the battery 49 and a positive terminal of an igniter 64*b* of an inflator 64*a* of the air bag module 64. On the other hand, the pair of front sensors 61*a* and 61*b* is connected to a negative terminal of the igniter 64*b* and ground.

Once one of the front sensors 61*a* and 61*b* and one of the safing sensors 61*c* and 61*d* are turned on, a current from the battery 49 energizes the igniter 64*b*. The igniter 64*b* ignites a contained ignition agent. A fire propagates from the ignition agent to a gas generating agent 64*d* through a fire propagating agent 64*c*. A large volume of a gas generated by the gas generating agent 64*d* passes into the air bag 64*e*. Thereupon, the air bag 64*e* breaks through grooves in a pad 64*f* to inflate and develop.

On the other hand, the input port of the I/O interface 45 of the ECU 40 receives a terminal voltage of the igniter 64*b*. The ECU 40 in the fourth embodiment detects a strong impact from a collision on the basis of a change in the terminal voltage of the igniter 64*b*.

FIG. 14 shows the fuel pressure control routine according to the fourth embodiment. After the ECU 40 is energized, once the car body receives a possible strong impact and one of the front sensors 61*a* and 61*b* and one of the safing sensors 61*c* and 61*d* of the air-bag sensor 61 are turned on, the igniter 64*b* of the air bag module 64 is energized by the current from the battery 49.

In a first execution of the routine after the igniter 64 is turned oh it is determined at step S61 that the igniter 64 has been turned on from a change in the terminal voltage of the igniter 64*b*. Subsequently, the process proceeds to step S31, where the ON-duty of the high pressure regulator 33 is set to be 0 (%). At step S32, this value is set to be the I/O port output value to the high pressure regular or 33. At step S33, the I/O port output value G1 to the relay coil of the feed pump relay 54 is set to be 0. At seep S34, the fuel pressure reduction flag $F_P$ is set. Subsequently, the process exits the routine.

In a subsequent execution of the routine, since step s34 the process has set the fuel pressure reduction flag $F_P$, the process proceeds from step S1 to step S31 and executes steps S31 to S34 as described above. After step S34, the process exits the routine. Thereafter, the process repeats the routine until the ECU 40 is deenergized.

Once it is determined that an emergency such as a collision has happened because of a turning on of the igniter 64*b*, the fuel pressure reduction flag $F_P$ is set and the operation of the feed pump 25 is stopped, the high pressure regulator 33 remains in the fully opened position, and the fuel pressure in the high pressure line 23*b* (see FIG. 1) is reduced. Even when the engine is stopped because of the de-energization of the ECU 40, the fuel pressure is reduced since the operation of the feed pump 25 is stopped and the high pressure regulator 33, which is the normally-open type, remains fully opened.

Since the fourth embodiment employs the air-bag sensor 61 of the air bag unit 60 as the degree of impact detection means, a car having the air bag unit 60 need not require the provision of a separate acceleration sensor. That is, this car effectively uses an existing device, so that the number of parts can be reduced and a maintenance of the car is easy.

In addition, since the fourth embodiment entrusts the determination whether the car has received a strong impact such as a collision to the operational accuracy of the air bag unit 60 having made a good showing, a more appropriate determination can be made.

The present invention is not limited to the above-described embodiments. For example, in modified forms of the first to third embodiments, a car having the air bag unit may use the air-bag sensor 61 in the fourth embodiment instead of the acceleration sensor 34 as the degree of impact detection means for detecting an impact such as a collision.

Advantages of the present invention are as follows:

In the first aspect of the present invention, the operation of the feed pump is stopped and the high pressure regulator is fully opened when a strong impact to the car body during an emergency such as a collision is detected, the fuel pressure has been already relieved from the high pressure regulator to the low pressure line even if the high pressure line of fuel system is damaged by the impact. Therefore, the system can previously prevent the fuel from blowing out of the damaged part. In addition, since the system predicts the damage in the fuel system from a rapid acceleration change, the system provides no trouble to a normal operation of the car and can accurately predicts the damage in the fuel system.

In the second aspect of the present invention, the relief line bypasses the high pressure regulator and connects the high pressure line to the low pressure return line. The relief line comprises the line switching means. The line switching means opens the relief line when the strong degree of impact to the car body is detected during an emergency such as a collision and then the operation of the feed pump is stopped. Thus, the fuel pressure in the high pressure line is rapidly relieved from the relief line to the low pressure line. Thus, the fuel pressure has been already sufficiently reduced when the high pressure line is damaged by the impact and therefore the fuel pressure control system can more easily suppress fuel from blowing out of the damaged part.

In the third aspect of the present invention, when a strong degree of impact on the car body is detected during an emergency Such as a collision, the switching means closes the low pressure delivery line upstream of the feed pump, and the high pressure regulator is fully opened and the operation of the feed pump is stopped. In addition, the low pressure return line has the check valve allowing fuel to return from the low pressure return line to the fuel tank. Thus, the fuel pressure control system of the third aspect of the present invention has the advantage that a vapor pressure in the fuel tank neither presses any residual fuel in the high pressure line nor blows fuel out of the damaged part in addition to the advantages of the first aspect of the present invention.

In the fourth aspect of the present invention, since the degree of impact detection means comprises the air-bag sensor of the air bag unit, a car having an air bag unit need not require the provision of a separate degree of impact detection means. Thus, the fuel pressure control system can reduce the number of parts and accurately determine an occurrence of emergency such as a collision.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A fuel pressure control system for a high pressure fuel injection engine, having a high pressure fuel pump and a high pressure regulator provided in a fuel system, a high pressure line connected between the high pressure fuel pump and the high pressure regulator, a low pressure delivery line connected between a fuel tank and the high pressure fuel pump, a low pressure return line interposed between the high pressure regulator and the fuel tank, a feed pump provided in the low pressure delivery line to deliver fuel to the high pressure fuel pump, and an injector connected to the high pressure line for directly injecting said fuel into a combustion chamber, comprising:

means for detecting a degree of impact; and control means for stopping the feed pump and for fully opening the high pressure regulator when the degree of impact exceeds a set value so as to rapidly relieve a high pressure and to avoid said fuel from blowing out of a damaged portion.

2. A fuel pressure control system according to claim 1, wherein said means for detecting a degree of impact comprises an air-bag sensor for turning on an igniter mounted to an inflator of an air bag unit.

3. A fuel pressure control system for a high pressure fuel injection engine having a high pressure fuel pump and a high pressure regulator provided in a fuel system, a high pressure line connected between the high pressure fuel pump and the high pressure regulator, a low pressure delivery line connected between a fuel tank and the high pressure fuel pump, a low pressure return line interposed between the high pressure regulator and the fuel tank, a feed pump provided in the low pressure delivery line to deliver fuel to the high pressure fuel pump, and an injector connected to the high pressure line for directly injecting said fuel into a combustion chamber, comprising:

means for detecting a degree of impact;

a relief line connected between the high pressure line and the low pressure line for bypassing the high pressure regulator;

line switching means provided in said relief line; and control means causing said line switching means to open said relief line and the feed pump to stop, when the degree of impact exceeds a set value.

4. A fuel pressure control system according to claim 3, wherein said means for detecting a degree of impact comprises an air-bag sensor for turning on an igniter mounted to an inflator of an air bag unit.

5. A fuel pressure control system for a high pressure fuel injection engine, having a high pressure fuel pump and a high pressure regulator provided in fuel system, a high pressure line connected between the high pressure fuel pump and the high pressure regulator, a low pressure delivery line connected between a fuel tank and the high pressure fuel pump, a low pressure return line interposed between the high pressure regulator and the fuel tank, a feed pump provided in the low pressure delivery line for deliver fuel to the high pressure fuel pump, and an injector connected to the high pressure line for directly injecting fuel into a combustion chamber, comprising:

means for detecting a degree of impact;

switching means provided in the low pressure delivery line upstream of the feed pump;

a check valve provided in the low pressure return line to allow said fuel to return from the low pressure return line to the fuel tank; and control means causing said switching means to close the low pressure delivery line and the high pressure regulator to be fully opened and the feed pump to stop, when the degree of impact exceeds a set value.

6. A fuel pressure control system according to claim 5, wherein said means for detecting a degree of impact comprises an air-bag sensor for turning on an igniter mounted to an inflator of an air bag unit.

* * * * *